US006200239B1

(12) United States Patent
Kennedy, III et al.

(10) Patent No.: US 6,200,239 B1
(45) **Date of Patent: *Mar. 13, 2001**

(54) MEDALLION GAMEBALL

(75) Inventors: Thomas J. Kennedy, III, Wilbraham, MA (US); Brian Feeney, Enfield, CT (US)

(73) Assignee: Spalding Sports Worldwide, Inc., Chicopee, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/405,898

(22) Filed: Sep. 24, 1999

Related U.S. Application Data

(63) Continuation-in-part of application No. 09/019,997, filed on Feb. 6, 1998, now Pat. No. 5,967,917.

(51) Int. Cl.[7] ..... A63B 41/08
(52) U.S. Cl. ..... 473/604; 473/607; 40/327
(58) Field of Search ..... 473/604, 569, 473/596, 597, 598, 599, 600, 603, 605, 607, 608, 52; 40/327

(56) References Cited

U.S. PATENT DOCUMENTS

| | | | | |
|---|---|---|---|---|
| 1,826,538 | | 10/1931 | Wollaston | 473/52 |
| 3,863,923 | | 2/1975 | Anderson | 473/604 |
| 3,879,876 | | 4/1975 | Morgan | 40/327 |
| 4,998,734 | | 3/1991 | Meyer | 40/327 |
| 5,320,345 | | 6/1994 | Lai et al. | 473/603 |
| 5,354,053 | | 10/1994 | Ratner et al. | 473/596 |
| 5,636,835 | * | 6/1997 | Schindler et al. | 473/605 |
| 5,681,233 | * | 10/1997 | Guenther et al. | 473/605 |
| 5,967,917 | * | 10/1999 | Feeney et al. | 473/604 |

* cited by examiner

*Primary Examiner*—Steven Wong

(57) ABSTRACT

A medallion ball comprising a bladder fabricated of an air impervious elastomeric material in a spherical configuration; a carcass coupled to the exterior surface of the bladder with a recess formed in the carcass; and a medallion positionable in a central region of the recess with the medallion having an exterior surface with indicia.

7 Claims, 5 Drawing Sheets

FIG 9
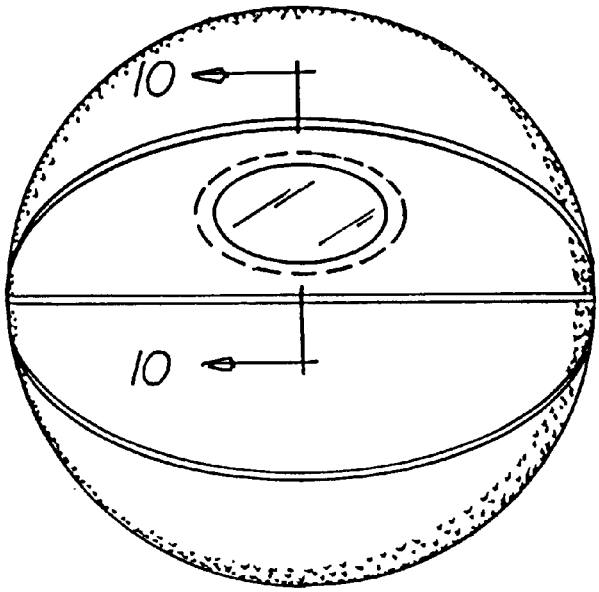
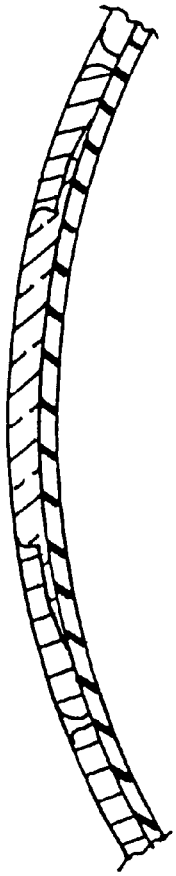
FIG 10

FIG 11
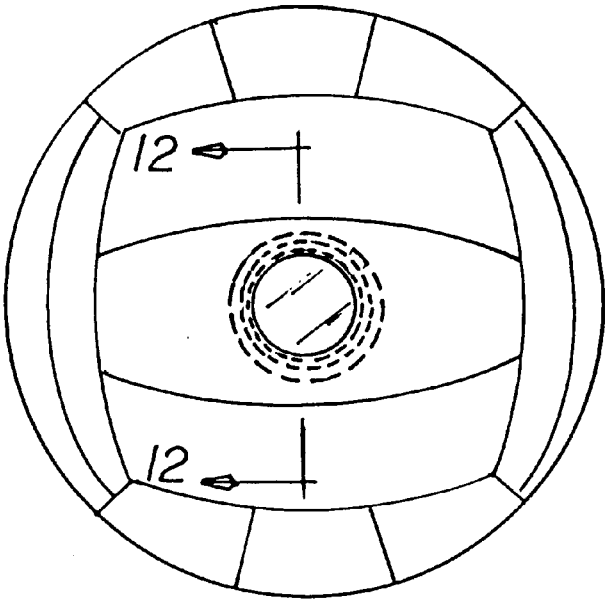
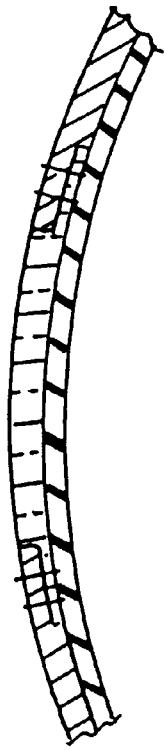
FIG 12

MEDALLION GAMEBALL

RELATED APPLICATION DATA

This application is a continuation in part of application Ser. No. 09/019,997 filed Feb. 6, 1998 now U.S. Pat. No. 5,967,917 incorporated herein by reference.

BACKGROUND OF THE INVENTION

1. Field of the Invention

The present invention relates to a medallion gameball and more particularly pertains to providing distinctive indicia in the form of a medallion on the surface of a basketball.

2. Description of the Prior Art

The use of balls with indicia of various designs and configurations is known in the prior art. More specifically, balls with indicia of various designs and configurations heretofore devised and utilized for the purpose of marking balls and other objects with indicia through various methods and apparatuses are known to consist basically of familiar, expected, and obvious structural configurations, notwithstanding the myriad of designs encompassed by the crowded prior art which has been developed for the fulfillment of countless objectives and requirements.

By way of example, note U.S. Pat. No. 5,320,345 to Lai et al., U.S. Pat. No. 5,419,552 to Meyer, U.S. Pat. No. 5,427,372 to Ratner et al., U.S. Pat. No. 5,497,699 to Mather, U.S. Pat. No. 5,518,234 to Palmquist and U.S. Pat. No. 3,091,562 to J. C. Berlepsch, Jr., et al.

While these devices fulfill their respective, particular objectives and requirements, the aforementioned patents do not describe medallion gameball that allows providing distinctive indicia in the form of a medallion to the surface of a basketball or other objects.

In this respect, the medallion gameball according to the present invention substantially departs from the conventional concepts and designs of the prior art, and in doing so provides an apparatus primarily developed for the purpose of providing distinctive indicia in the form of a medallion to the surface of basketballs.

Therefore, it can be appreciated that there exists a continuing need for a new and improved medallion gameball which can be used for providing distinctive indicia in the form of a medallion to the surface of basketballs. In this regard, the present invention substantially fulfills this need.

SUMMARY OF THE INVENTION

In view of the foregoing disadvantages inherent in the known types of balls with indicia of various designs and configurations now present in the prior art, the present invention provides an improved medallion gameball. As such, the general purpose of the present invention, which will be described subsequently in greater detail, is to provide a new and improved medallion gameball and method which has all the advantages of the prior art and none of the disadvantages.

To attain this, the present invention essentially comprises a bladder fabricated of an air impervious elastomeric material in a spherical configuration with spiral strands therearound; a carcass in a spherical configuration overlying the strands with a recess formed as an oval formed in its exterior surface, the oval having a depth of between about 0.5 and 3.5 millimeters, preferably about 2.0 millimeters, with a major axis constituting between 3 and 20 percent, preferably about 8.5 percent, of the circumference of the carcass, the carcass having a series of oval ribs with a thickness of between about 0.2 and 2.0 millimeters, preferably about 1.0 millimeters, extending outwardly away from the bladder; a plurality of panels coupled to the exterior surface of the carcass between the ribs, the panels having a thickness of between about 0.2 and 2.0 millimeters, preferably about 1.0 millimeters, with an oval aperture formed in one of the panels to expose the recess in the carcass and an oval rib; and a medallion positioned on the carcass in a central region of the recess with the medallion having an exterior surface with indicia formed thereon with a layer of a transparent polymer over the indicia.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved medallion gameball which has all of the advantages of the prior art balls with indicia of various designs and configurations and none of the disadvantages.

It is another object of the present invention to provide a new and improved medallion gameball which may be easily and efficiently manufactured and marketed.

It is further object of the present invention to provide a new and improved medallion gameball which is of durable and reliable constructions.

An even further object of the present invention is to provide a new and improved medallion gameball which is susceptible of a low cost of manufacture with regard to both materials and labor, and which accordingly is then susceptible of low prices of sale to the consuming public, thereby making such Medallion gameball economically available to the buying public.

Even still another object of the present invention is to provide a medallion gameball for providing distinctive indicia in the form of a medallion to the surface of basketballs.

Lastly, it is an object of the present invention to provide a new and improved medallion gameball including a bladder fabricated of an air impervious elastomeric material in a spherical configuration with spiral strands there around, a carcass coupled to the exterior surface of the bladder with a recess formed in the carcass, and a medallion positionable in a central region of the recess with the medallion having an exterior surface with indicia formed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 9 is a view of a gameball employing a flanged medallion.

FIG. 10 is a sectional view taken along line 10—10 of FIG. 9.

FIG. 11 is a view of a volleyball employing the flanged medallion of the present invention.

FIG. 12 is a sectional view taken along line 12—12 of FIG. 11.

The same reference numerals refer to the same parts through the various figures.

DESCRIPTION OF THE PREFERRED EMBODIMENT

Figure 1:
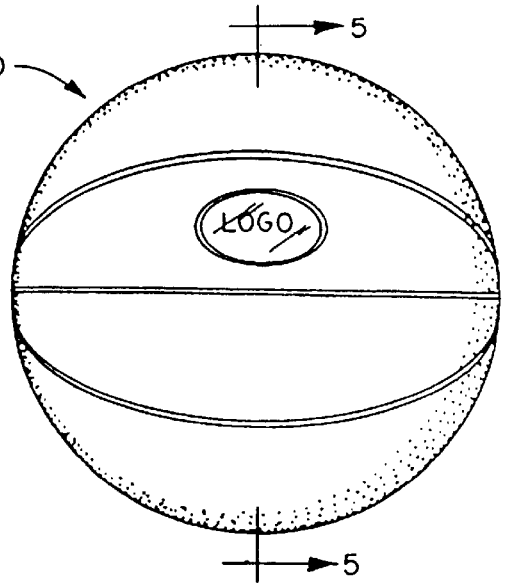
FIG. 1 is a perspective view of the preferred embodiment of the medallion gameball constructed in accordance with the principles of the present invention.
Figure 2:
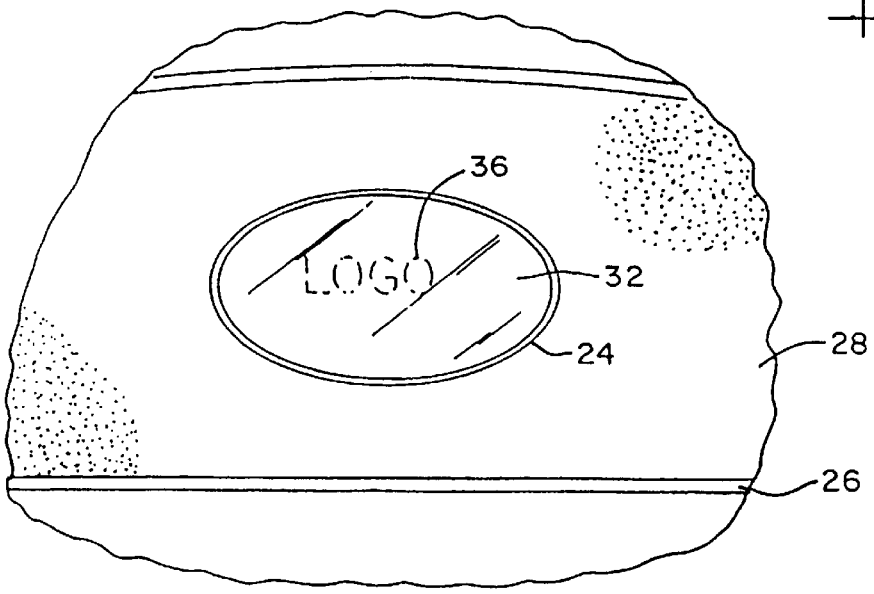
FIG. 2 is an enlarged view of the medallion portion of the ball of FIG. 1.
Figure 3:
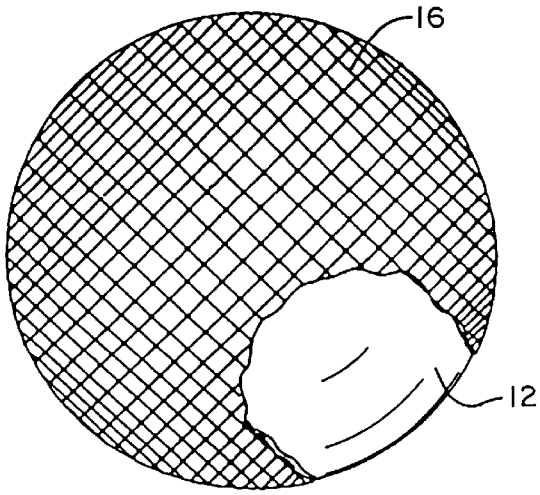
FIG. 3 is similar to FIG. 1 without the exterior covering to expose the interior structure.
Figure 4:
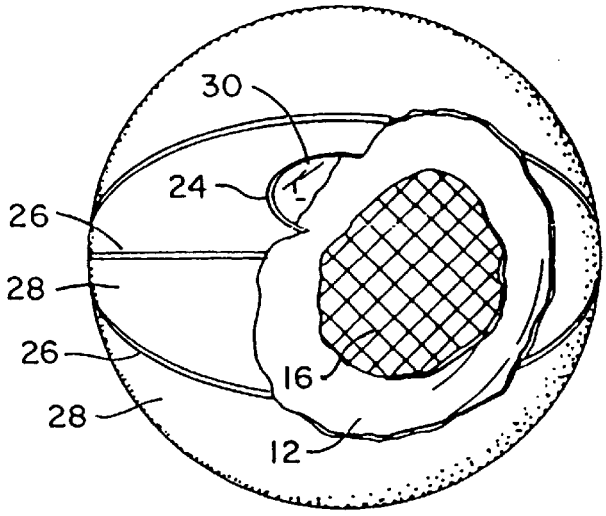
FIG. 4 is similar to FIGS. 1 and 3 with only a portion of the interior exposed.
Figure 5:
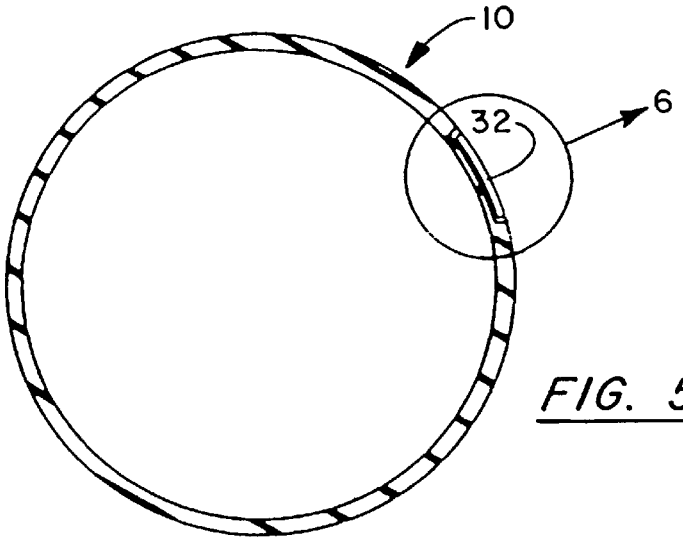
FIG. 5 is a cross sectional view taken along line 5—5 of FIG. 1.
Figure 6:
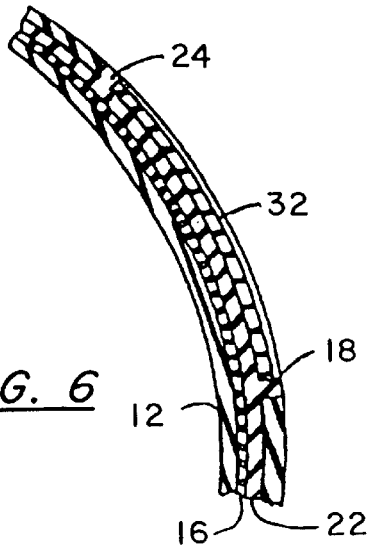
FIG. 6 is an enlarged view taken at the circle 6 of FIG. 5.

With reference now to the drawings, and in particular to FIG. 1 thereof, the preferred embodiment of the new and improved medallion gameball embodying the principles and concepts of the present invention and generally designated by the reference numeral 10 will be described.

The present invention, the medallion gameball 10 is comprised of a plurality of components. Such components in their broadest context include a bladder, windings, carcass, leather panels and a medallion. Such components are individually configured and correlated with respect to each other so as to attain the desired objectives.

The central component of the medallion basketball is a bladder 12. Such bladder is preferably fabricated of an air impervious elastomeric material in a spherical configuration. The preferred material is a vulcanized butyl rubber compound, such as, for example, Exxon Butyl 065 or Polysar Butyl 100. Such bladder is formed with spiral strands 16 therethrough. Such strands are of essentially inelastic material, preferably nylon or polyester multifilament strands wrapped around the bladder in random configuration to maintain the size and shape of the ball when inflated and during use.

A carcass 22 is formed over the windings. Such carcass is fabricated of a rubber compound molded over the wound bladder, Natural rubber (cis polyisoprene) is preferred for improved rebound and abrasion resistance. A mixture of rubbers may also be used, such as natural rubber and styrene butadiene rubber Such carcass has an oval rib 24. Such rib has a thickness of between about 0.2 and 2.0 millimeters, preferably about 1.0 millimeters. In addition, a plurality of supplemental ribs 26 are provided. Such ribs have a thickness of between about 0.2 and 2.0 millimeters, preferably about 1.0 millimeters extending outwardly away from the bladder.

The carcass is molded to include a recess 18. The recess is formed as an oval in the exterior surface of the carcass. The recess area has a depth of between about 0.5 and 3.5 millimeters, preferably 2.0 millimeters. The major axis of the oval constitutes between 3 and 20 percent, preferably about 8.5 percent, of the circumference of the carcass.

The basketball 10 also comprises a plurality of panels 28, preferably leather, coupled to the exterior surface of the carcass between the supplemental ribs. Such panels may be of a natural leather or of a synthetic leather. These panels have a thickness of between about 0.2 and 2.0 millimeters, preferably about 1.0 millimeters. An oval aperture 30 is formed in one of the panels to expose the recess in the carcass and the oval rib.

Finally, the new and improved and medallion basketball comprises a medallion 32 positionable on the carcass in a central region of the recess. The medallion is shown as oval but may be round or of any other shape. The medallion is fabricated of a rigid or semi-rigid polymeric material and has an exterior surface 34 with indicia 36 formed thereon. The medallion is preferably secured in position by a pressure sensitive adhesive or a flexible cross-linked urethane adhesive. A layer of a conventional transparent polymer is formed over the indicia 36 for protective purposes.

Other adhesives are also suitable for use in securing the medallion to the carcass. One such adhesive is a pressure sensitive hot melt adhesive, such as PL919 offered by SIA Adhesives, Inc. of Chicago Ill. In the preferred embodiment, a layer of between 0.005" and 0.015" is applied to the back of the medallion. Subsequently, both the medallion and the ball are warmed with a heat gun for between 10–15 seconds. The goal of such heating is to bring the adhesive to about 250 degrees fahrenheit. After being warmed, the medallion is pressed into position in such a manner that intimate contact between the ball and medallion is achieved. To this end, a contoured tool may be utilized. Upon cooling, the medallion is secured.

A second possible adhesive is a pressure sensitive adhesive. One such pressure sensitive adhesive is a system from 3M which employs a #300LSE high strength acrylic adhesive and 9671LE and 9672LE laminating adhesives. In utilizing such a system, heat is not required to activate the adhesive, but is helpful in ensuring proper contact between the carcass and medallion.

A contact adhesive is yet another alternative. A suitable contact adhesive is 3M's 1357 contact adhesive. In utilizing this alternative, the contact adhesive is applied to both the ball and medallion. The adhesive is then allowed to flash, thereby removing the liquid from the adhesive and increasing its tackiness. Optionally, a second layer of adhesive can then be applied. The medallion and carcass are then brought into contact. After 24 hrs a full strength bond is achieved. As will all the above described adhesive alternatives, cleaning the bonded surfaces before adhesive application results in superior results. Alcohol, or other suitable solvents, can be employed in cleaning the surfaces. Additionally, adhesive promoters or primers can be used. An example of a suitable primer is Lord Corporation's Chemlock 77707 primer.

The above described application methods can also be employed with a flanged medallion 52. Such flange 54 is integral with the periphery of the medallion 52 and is used in securing the medallion 52 in place. More specifically, the flange 54 is covered by one or more of the plurality of panels of the ball. In this manner, the flanged medallion 52 provides for increased securement between the medallion 52 and ball. In the preferred embodiment the flange 54 is between ⅛" to ¼" in width and is formed about the entire perimeter of the medallion 52. In an alternative embodiment, the flange 54 is scalloped is reduce wrinkling once secured to the ball. The flange 54, however, is not covered with the urethane dome, as is the center of the medallion 52. Additionally, the upper panel 56 of the ball includes a cut out 58 sized to expose the center of the medallion 52, but not the flange 54. Namely, when secured the laminated panel 56 covers the flange 54 but not the urethane dome. In this manner only the dome portion of the medallion 52 is visible.

The preferred thickness of the medallion 52 is about 0.05" with a manufacturing tolerance on thickness of about +/−0.10. Such a thickness enables the surface of the medallion 52 to be flush with the remainder of the surface of the ball. The medallion 52 can be formed into a variety of shapes. Nonetheless, the preferred medallion 52 has major diameters of 1.5" and 2.6". An alternative size employs diameters of 1.3" and 2.4". The size and shape of the medallion 52 is, in part, dependent upon the type of ball upon which it is employed. For example, the medallions of the present invention can be affixed to other types of inflated balls, including soccer balls, volleyballs and footballs. An example of a volleyball employing the flanged medallion 52 is illustrated in FIG. 11.

Figure 7:
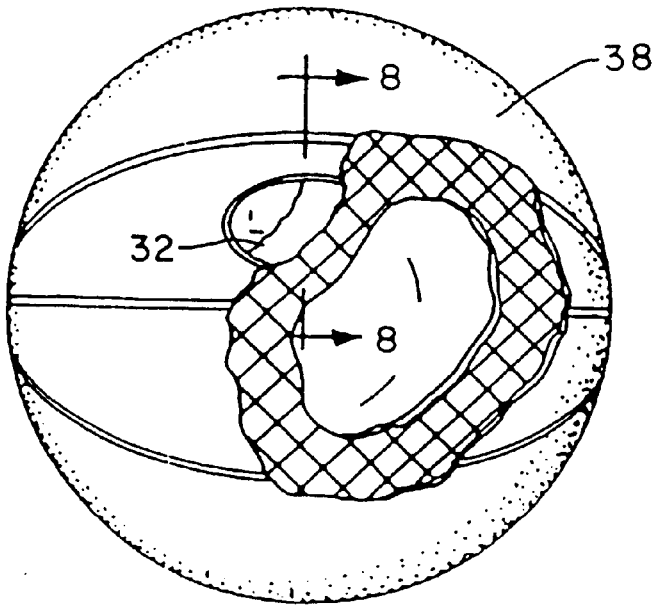
FIG. 7 is similar to FIGS. 1, 3 and 4 but illustrating an alternative embodiment of the invention.
Figure 8:
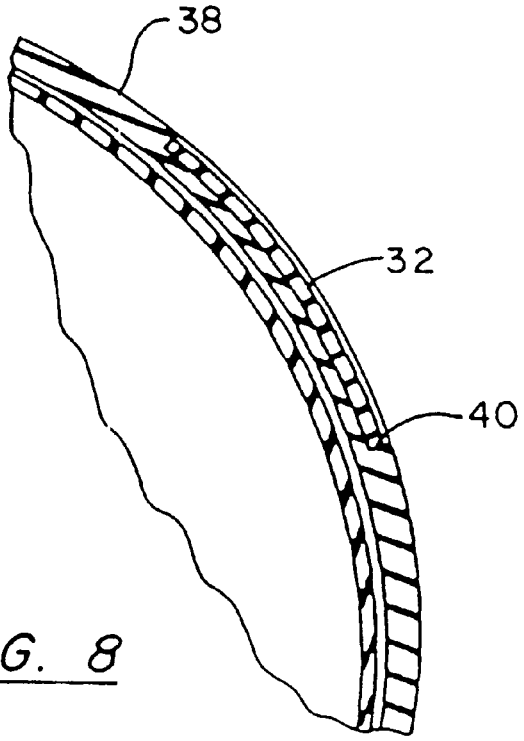
FIG. 8 is an enlarged cross sectional view taken along line 8—8 or FIG. 7.

An alternative embodiment of the invention is shown in FIGS. 7 and 8. In such embodiment, the panels 38 are formed integral with the carcass. Such panels are preferably formed with a surface to simulate the appearance and feel of natural leather. In such embodiment the carcass of the ball also includes a recess 40 molded therein to a depth equal to the depth of the carcass between the ribs where the medallion is received. as in the primary embodiment as discussed above and with a medallion discussed above. This allows for a less costly fabrication as then would occur with the primary embodiment with the separate leather panels coupled to the carcass.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A medallion basketball comprising:

a bladder fabricated of an air impervious elastomeric material in a spherical configuration with spiral strands therearound;

a carcass in a spherical configuration overlying the strands with a recess formed as an oval formed in its exterior surface;

a plurality of panels coupled to the exterior surface of the carcass between the ribs, the panels having a thickness of between about 0.2 and 2.0 millimeters with an oval aperture formed in one of the panels to expose the recess in the carcass and an oval rib; and a medallion positioned on the carcass in a central region of the recess with the medallion having an exterior surface with indicia formed thereon with a layer of a transparent polymer over the indicia.

2. A medallion ball comprising:

a bladder fabricated of an air impervious elastomeric material in a spherical configuration with spiral strands there around;

a carcass coupled to the exterior surface of the bladder, the carcass having an exterior surface with a recess formed in the carcass;

a plurality of panels coupled to the exterior surface of the carcass; and an oval medallion positionable in a central region of the recess with the medallion having an exterior surface with indicia formed, the medallion having an oval peripheral flange with the flange being covered by one of the panels.

3. The ball as set forth in claim 2 wherein the carcass includes panels of leather.

4. The ball as set forth in claim 2 wherein the leather is natural.

5. The ball as set forth in claim 2 wherein the leather is synthetic.

6. The ball as set forth in claim 2 wherein the panels are adhered to the carcass.

7. The ball as set forth in claim 2 wherein the carcass includes panels of rubber or other elastomeric material that are vulcanized or cured with the carcass.

* * * * *